US010329721B2

(12) United States Patent
Xie

(10) Patent No.: US 10,329,721 B2
(45) Date of Patent: Jun. 25, 2019

(54) FOLDABLE TRAFFIC CONE

(71) Applicant: Qionghui Xie, Sichuan (CN)

(72) Inventor: Qionghui Xie, Sichuan (CN)

( * ) Notice: Subject to any disclaimer, the term of this patent is extended or adjusted under 35 U.S.C. 154(b) by 0 days.

(21) Appl. No.: 15/693,532

(22) Filed: Sep. 1, 2017

(65) Prior Publication Data

US 2018/0327984 A1 Nov. 15, 2018

(30) Foreign Application Priority Data

May 11, 2017 (CN) ..... 2017 2 0522631 U

(51) Int. Cl.
*E01F 9/654* (2016.01)
*E01F 9/688* (2016.01)

(52) U.S. Cl.
CPC ..... *E01F 9/654* (2016.02); *E01F 9/688* (2016.02)

(58) Field of Classification Search
CPC ..... E01F 9/688; E01F 9/654
USPC ..... 116/63 C, 63 P, 63 T, 63 R, 173, 200
See application file for complete search history.

(56) References Cited

U.S. PATENT DOCUMENTS 2,275,711 A * 3/1942 Ybanez ..... E01F 9/688 116/63 C
2,954,005 A * 9/1960 Cioffi ..... E01F 9/688 116/63 C
3,707,320 A * 12/1972 Brynes ..... E01F 9/688 116/63 C
4,006,702 A * 2/1977 St. Cyr ..... E01F 9/688 116/63 P
4,197,807 A * 4/1980 Campbell ..... E01F 9/688 116/63 P
4,256,050 A * 3/1981 Barnard ..... B60Q 7/005 116/63 C
4,489,306 A * 12/1984 Scolari ..... E01F 9/646 116/63 P
D327,231 S * 6/1992 Mazzola ..... D10/113.2
D348,412 S * 7/1994 Hazelton ..... D10/113.2
5,529,429 A * 6/1996 Pelegrin ..... B60Q 7/00 116/63 C
5,599,132 A * 2/1997 Hughes, Jr. ..... E01F 15/003 116/63 P
6,071,037 A * 6/2000 Holt ..... A47F 3/142 116/63 P
6,119,409 A * 9/2000 Makar ..... A01K 1/00 441/129

(Continued)

*Primary Examiner* — Justin Seo
*Assistant Examiner* — Tania C Courson

(57) ABSTRACT

The present invention relates to a foldable traffic cone, comprising a base, a foldable section, and a pull ring, wherein the foldable portion comprises one or more foldable members and a connecting member, each foldable member comprises a first foldable segment, a first fold and a second foldable segment from top to bottom, and a second fold is disposed between the second foldable segment and the connecting member; the pull ring is disposed on the top of the first foldable segment, wherein when a plurality of foldable members are present, a second fold is disposed between the second foldable segment and the first foldable segment and at least the foldable portion is integrated structure molded integrally. According to the foldable traffic cone provided by the present invention, it can work just by pulling and pressing the pull ring, and it is convenient to carry and store and has high practicability.

13 Claims, 5 Drawing Sheets

(56) References Cited

U.S. PATENT DOCUMENTS

| | | | | |
|---|---|---|---|---|
| 6,338,311 | B1 * | 1/2002 | Ho | E01F 9/688 116/63 C |
| D597,432 | S * | 8/2009 | Auberger | D10/113.2 |
| D617,402 | S * | 6/2010 | Fuccillo | D10/113.2 |
| 7,766,386 | B2 * | 8/2010 | Spingler | F16F 7/125 280/751 |
| 9,689,123 | B2 * | 6/2017 | Chi | E01F 9/654 |
| 2002/0062780 | A1 * | 5/2002 | Chen | B60Q 7/005 116/63 P |
| 2006/0219153 | A1 * | 10/2006 | Tipaldo | E01F 9/688 116/63 C |
| 2012/0076970 | A1 * | 3/2012 | Suter | E01F 13/028 428/80 |
| 2014/0015692 | A1 * | 1/2014 | Sun | E01F 9/688 340/908 |
| 2014/0230719 | A1 * | 8/2014 | Thomas | E01F 9/654 116/63 C |
| 2018/0058022 | A1 * | 3/2018 | Adeleke | E01F 9/688 |

* cited by examiner

FOLDABLE TRAFFIC CONE

CROSS REFERENCE TO RELATED APPLICATIONS

The present application claims the benefit of Chinese Patent Application No. 201720522631.9 filed on May 11, 2017. All the above are hereby incorporated by reference.

TECHNICAL FIELD

The present invention belongs to the technical field of road traffic safety and relates to a foldable traffic cone.

BACKGROUND ART

With the development of economy, the traffic gets more and more developed, and in the field of road traffic, it is often necessary to divide the traffic stream, guide the traffic and the like. For example, during highway maintenance, traffic police law enforcement, and road administration enforcement and in hotels, communities, sports places, dangerous areas, and road construction sites, traffic cones are generally arranged at corresponding places to guide the vehicles to bypass the dangerous road sections, to guide the traffic and the like, or in the case of a road traffic accident or a vehicle fault, the traffic cones will be quickly put behind a vehicle site to alert the incoming vehicles for traffic safety.

However, an existing traffic cone which is generally made of a hard plastic material has a fixed shape and is not deformable, thus making the traffic cone larger in overall size, difficult to store and inconvenient to carry and use.

SUMMARY OF THE INVENTION

The technical problem the present invention attempts to solve is to provide a foldable traffic cone with respect to the defects of larger overall size, inconvenience in storage and carrying for the foregoing existing traffic cone in the prior art.

To solve the technical problem of the present invention, a technical solution is employed as follows: a foldable traffic cone is constructed and comprises:

a base;

a conical or frustum-shaped hollow foldable portion, comprising one or more foldable members and a connecting member connected with the base from top to bottom in sequence, each foldable member comprising a first foldable segment, a first fold and a second foldable segment from top to bottom in sequence, and a second fold being disposed between the second foldable segment at a bottom end of the foldable portion and the connecting member;

a pull ring, which is disposed on the top of the first foldable segment at a top end of the foldable portion, wherein when a plurality of foldable members are present, a second fold is disposed between the second foldable segment of each of the foldable members and the first foldable segment of an adjacent foldable member located therebelow; and at least the foldable portion is an elastically deformable integrated structure molded integrally.

As a preferred solution of the present invention, the thickness of the second fold is more than the thickness of the first fold.

As a preferred solution of the present invention, both the first fold and the second fold are annular concave slots.

As a preferred solution of the present invention, a support ring for supporting is disposed at least at the upper part of the inner wall of the first foldable segment of each foldable member As a preferred solution of the present invention, the thickness of the first foldable segment is more than the thickness of the second foldable segment.

As a preferred solution of the present invention, at least two of the pull ring, the foldable portion and the base are of an integrated structure molded from silicone integrally.

As a preferred solution of the present invention, both the first fold and the second fold are annular convex arc-shaped raised edges.

As a preferred solution of the present invention, the first foldable segment is of a big-end-down frustum shape; the second foldable segment has a side wall being a concave arc-shaped surface and is provided with convex rings at the top and the bottom, and the convex ring at the top has an outer diameter more than the outer diameter of the bottom of the adjacent first foldable segment; and the outer diameter of the convex ring at the bottom is more than the outer diameter at the top of each of the first fold and the first foldable segment.

As a preferred solution of the present invention, the first foldable segment or/and the second foldable segment is/are provided with a reflective tape(s) on an outer peripheral wall(s).

As a preferred solution of the present invention, the base is provided with a balancing weight.

With the implementation of the foldable traffic cone provided by the present invention, the following advantageous effects can be achieved: the foldable portion is foldable and expandable so that the traffic cone can be used as long as the pull ring is pulled to expand the foldable portion; likewise, the traffic cone can be collected as long as the pull ring is pressed to fold the foldable portion up, thereby achieving convenience in carrying and storage; the foldable portion is foldable and expandable, i.e., the first foldable segment in the foldable member can drive the second foldable segment through the first fold to be folded inwards or outwards to further fold or unfold the first foldable segment and the second foldable segment; and when multiple foldable members are present, the upper foldable member can drive the lower foldable member to fold or unfold the first and second foldable segments of the lower foldable member, thus folding and unfolding the foldable portion.

BRIEF DESCRIPTION OF THE DRAWINGS

The present invention will be described as embodiments below with reference to accompanying drawings, in which.

DESCRIPTION OF THE PREFERRED EMBODIMENTS

Figure 1:
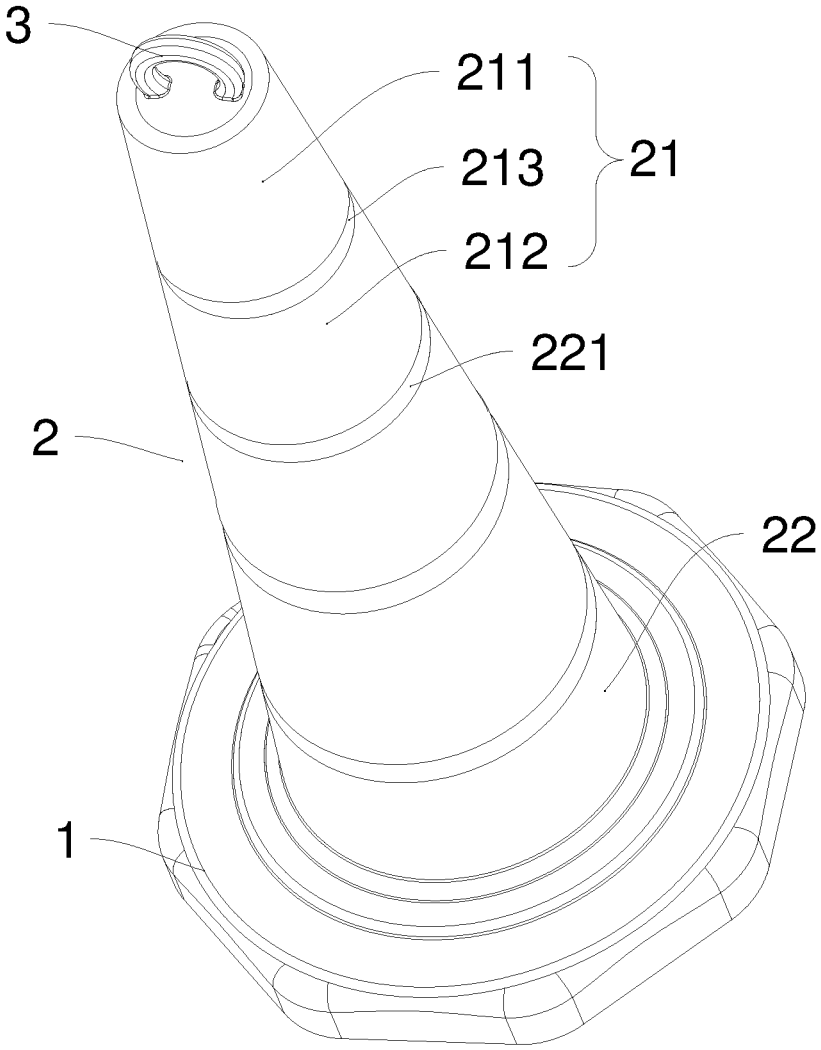
FIG. 1 is a schematic diagram showing a structure of a foldable traffic cone in an expanded state according to Embodiment 1 of the present invention.
Figure 2:
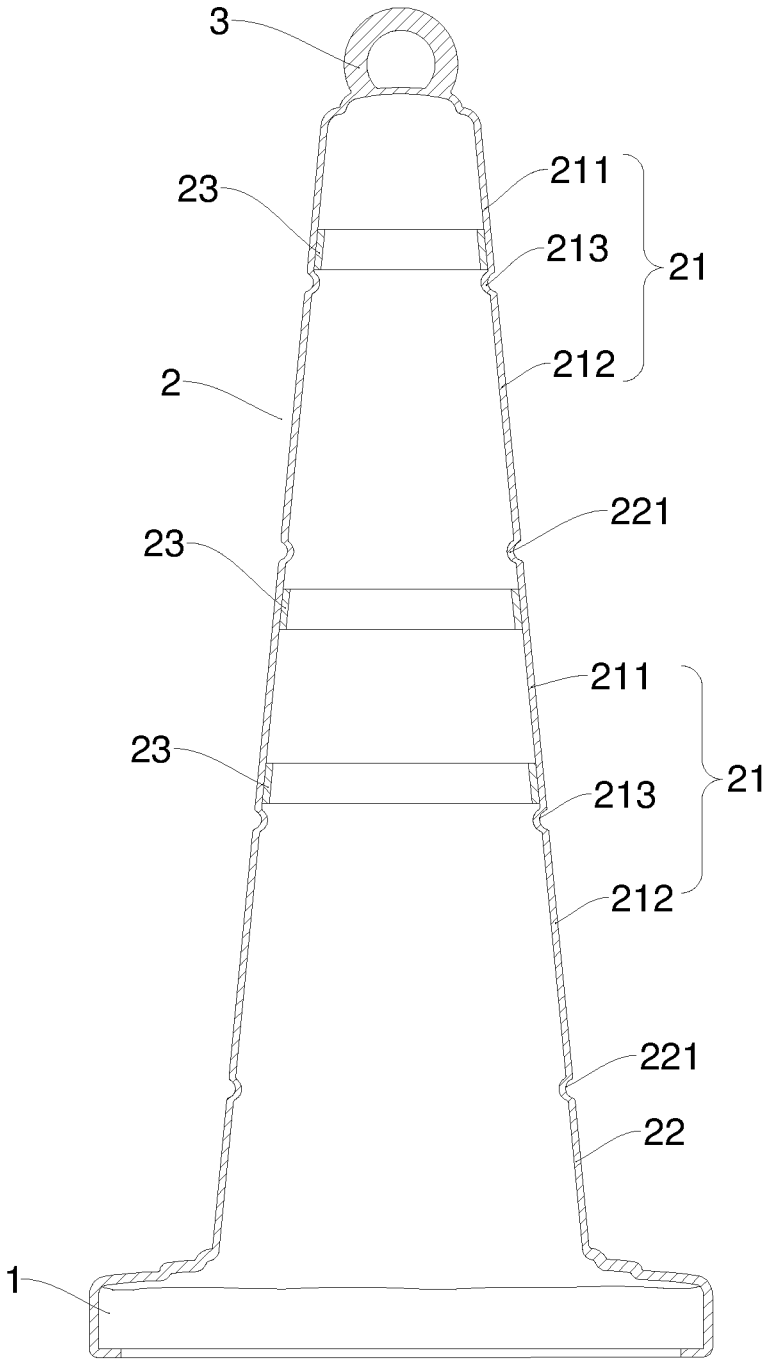
FIG. 2 is a longitudinal section view of FIG. 1.
Figure 3:
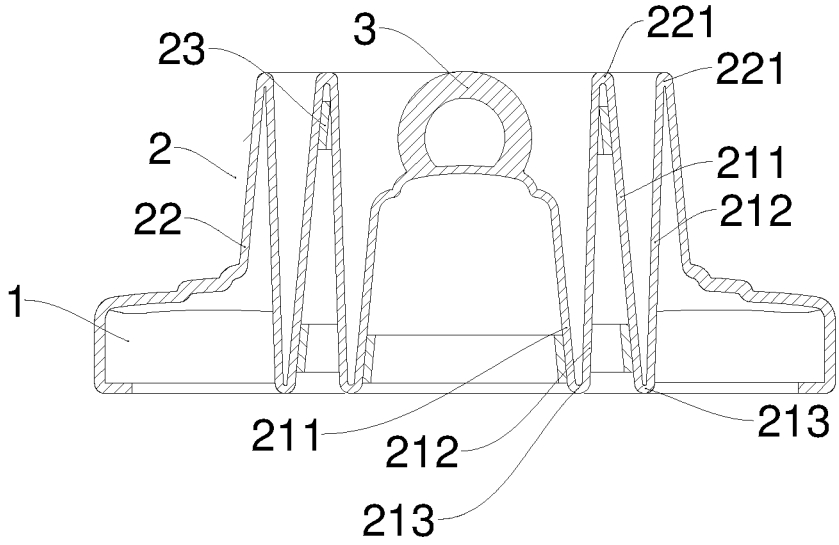
FIG. 3 is a sectional view of the foldable traffic cone in a folded state according to Embodiment 1 of the present invention.

Embodiment 1: as shown in FIG. 1 to FIG. 3, this embodiment provides a foldable traffic cone, comprising a base 1, a conical or frustum-shaped hollow foldable portion 2, and a pull ring 3, wherein the foldable portion 2 comprises one or more foldable members 21 and a connecting member 22 connected with the base 1 from top to bottom in sequence, each foldable member 21 comprises a first foldable segment 211, a first fold 213 and a second foldable segment 212 from top to bottom in sequence, and a second fold 221 is disposed between the second foldable segment 212 at a bottom end of the foldable portion 2 and the connecting member 22; the pull ring 3 is disposed on the top of the first foldable segment 211 at a top end of the foldable portion 2; when multiple foldable members 21 are present, a second fold 221 is disposed between the second foldable segment 212 of each of the foldable members 21 and the first foldable segment 211 of an adjacent foldable member 21 located therebelow; and at least the foldable portion 2 is an elastically deformable integrated structure molded integrally.

As is described above, specifically, the foldable portion 2 is foldable and expandable, where, as shown in FIG. 1 and FIG. 2, FIG. 2 is a section view of the foldable cone in an expanded state in this embodiment, that is, the foldable portion 2 can be expanded by pulling the pull ring 3, that is, the first foldable segment 211 in the foldable member 21 can drive the second foldable segment 212 through the fold 213 to be folded outwards, thereby further stretching and expanding between the first foldable segment 211 and the second foldable segment 212; and thus, the traffic cone has a conical or frustum-shaped whole structure, that is, each foldable member 21 takes the shape of a hollow frustum, preferably takes the shape of a circular cone or a circular frustum, and the shape of the circular cone or circular frustum is a big-end-down shape formed by rotating an inclined straight line or curved line for a circle around a center axis. For the convenience in folding, the bottom of one foldable member 21 preferably has the maximal outer diameter that is less than the outer diameter of the top of the adjacent foldable member 21 located therebelow.

Likewise, as shown in FIG. 3, FIG. 3 is a sectional view of the traffic cone in a folded state in this embodiment, where the foldable portion 2 can be folded by pressing the pull ring 3 to achieve the convenience in carrying and storage and the like; and that is, the first foldable segment 211 in the foldable member 21 can drive the second foldable segment 212 through the fold 213 to be folded inwards, thereby further folding and contracting between the first foldable segment 211 and the second foldable segment 212.

It can be understood that when multiple foldable members 21 are present (two foldable members 21 are preferred in this embodiment), the upper foldable member 21 can drive the lower foldable member 21 to fold or unfold the first foldable segment 211 and the second foldable segment 212 thereof for further folding the foldable portion 2.

As is described above, it can be understood that the denomination of the first foldable segment 211, the second foldable segment 212, the first fold 213 and the second fold 221 is only for the convenience of description, but not intended to limit the structure (such as height) as long as the effect and function described above are achieved in practice.

As is described above, it can be understood that the quantity of the foldable member 21 is depend on the actual condition (such as the height of the first foldable segment 211 and the height of the second foldable segment 212); certainly, in the actual production, the quantity of the foldable member 21 and the height of the first foldable segment 211 or the second foldable segment 212 may be slightly higher, and further during the actual use, a user may pull out part or all of the foldable members 21 as required to flexibly set the height of the foldable traffic cone on the premise of guaranteeing alert safety.

Preferably, in this embodiment, the pull ring 3 is fixedly connected to or integrally molded together with the first foldable segment 211 at a top end of the foldable portion 2; and certainly, for the convenience of production, integral molding is preferred in this embodiment.

In the foldable traffic cone, at least the foldable portion 2 is an integrated structure molded integrally. The integrated structure refers to a whole made with a one-step molding process. It is preferred that at least two of the pull ring 3, the foldable portion 2 and the base 1 are of an integrated structure molded integrally, for example, the pull ring 3 and the foldable portion 2 are molded integrally, and the base 1 and the foldable portion 2 are fixedly connected in an undetachable or detachable way. The foldable portion 2 and the base 1 are integrally molded and the pull ring 3 and the foldable portion 2 are fixedly connected in an undetachable or detachable way. The pull ring 3, the foldable portion 2 and the base 1 are molded integrally. A material for the integral molding can be selected from but not limited to an elastic deformation polymer material, a metallic material and the like. The material of the foldable portion 2 is at least the elastically deformable silicone or other plastic materials, a silicone or plastic material is light and has better plasticity, flexibility, mechanical strength and the like; and certainly, in this embodiment, both the pull ring 3 and the base 1 may also employ a material the same as that for the foldable portion 2, and may be made of plastic, metal and other materials having certain hardness.

It can be understood that in the this embodiment, as shown in FIG. 2 and FIG. 3, it is necessary for the foldable traffic cone provided by the this embodiment to prevent the first foldable segment 211 from folding up during the expansion and contraction of the foldable portion 2, and the second foldable segment 212 needs to be folded inwards during contraction and folded outwards during expansion; in the actual operation, when the pull ring 3 is pulled or pressed and when the foldable portion 2 is expanded or is folded for contraction, it is random and uncontrollable for the first foldable segment 211 and the second foldable segment 212 to undergo a folding phenomenon, that is, it is possible for the first foldable segment 211 to fold up, it is also possible for the second foldable segment 212 to fold up, therefore, the success rate of folding contraction or expansion is not high.

Therefore, as shown in FIG. 2 and FIG. 3, preferably, a support ring 23 for supporting is disposed on an inner wall of the first foldable segment in the this embodiment, further, the support ring 23 may be clamped on the inner wall of the first foldable segment 211 to play the supporting role, so that the first foldable segment 211 can be prevented from deformation when the foldable portion 2 is folded to contract or unfolded to expand, that is, the first foldable segment 211 can be prevented from being folded over, further, the second foldable segment 212 can be folded inwards during contraction or folded outwards during expansion when the foldable portion 2 is folded to contract or unfolded to expand; the controllability, success rate and the like can be ensured for the folding contraction and expansion of the foldable portion 2, thereby guaranteeing the smoothness in the folding contraction and expansion of the foldable traffic cone.

Specifically, in the this embodiment, as shown in FIG. 2 and FIG. 3, the support ring 23 is disposed on an inner wall at the lower part of the first foldable segment 211 on the top end of the foldable portion 2.

The support rings 23 are disposed on upper and lower inner walls for the rest of the first foldable segments 211.

Meanwhile, it can be understood that to guarantee the controllability, success rate and the like during the folding contraction and expansion of the foldable portion 2 and guarantee the smoothness in the folding contraction and expansion of the foldable traffic cone in the this embodiment, it is also preferred that the thickness of the second fold 221 is more than the thickness of the first fold 213, that is, the first fold 213 is easier to deform compared with the second fold 221, so that the first foldable segment 211 is stressed when the pull ring 3 is pulled or pressed to further drive the first fold 213 to deform for driving the second foldable segment 212 to fold inwards or outward, thereby possibly preventing the first fold segment 211 from folding up.

More preferably, in the this embodiment, as shown in FIG. 2 and FIG. 3, the first fold 213 is an annular concave groove for the convenience of folding or unfold, thereby possibly further increasing the smoothness and ease and the like in the folding and unfolding.

Certainly, for the convenience of production and better folding or unfolding, both the first fold 213 and the second fold 221 can be configured as annular concave grooves in the this embodiment.

Preferably, as shown in FIG. 1, the first foldable segment 211 or/and the second foldable segment 212 is/are provided with a reflective tape(s) 24 on an outer peripheral wall(s).

As is described above, the reflective tape 24 may play a role of alerting, has a reflective film and is further fixed on the first foldable segment 211 or/and the foldable segment 212 in an adhesive manner.

Preferably, the base 1 is provided with a balancing weight.

Specifically, since the foldable portion 2 is made of silicone or plastic and to guarantee the convenience in transporting and carrying the foldable traffic cone, the foldable cone is lighter in overall weight and may be easily blown away in the case of heavy wind and other conditions, therefore, a balancing weight (not shown in the drawing due to a simple structure) which can be sleeved on the base 1 can be disposed in the this embodiment, further, the balancing weight can increase the wind resistance for the foldable traffic cone, and the foldable traffic cone can be folded up after the balancing weight is removed.

Figure 4:
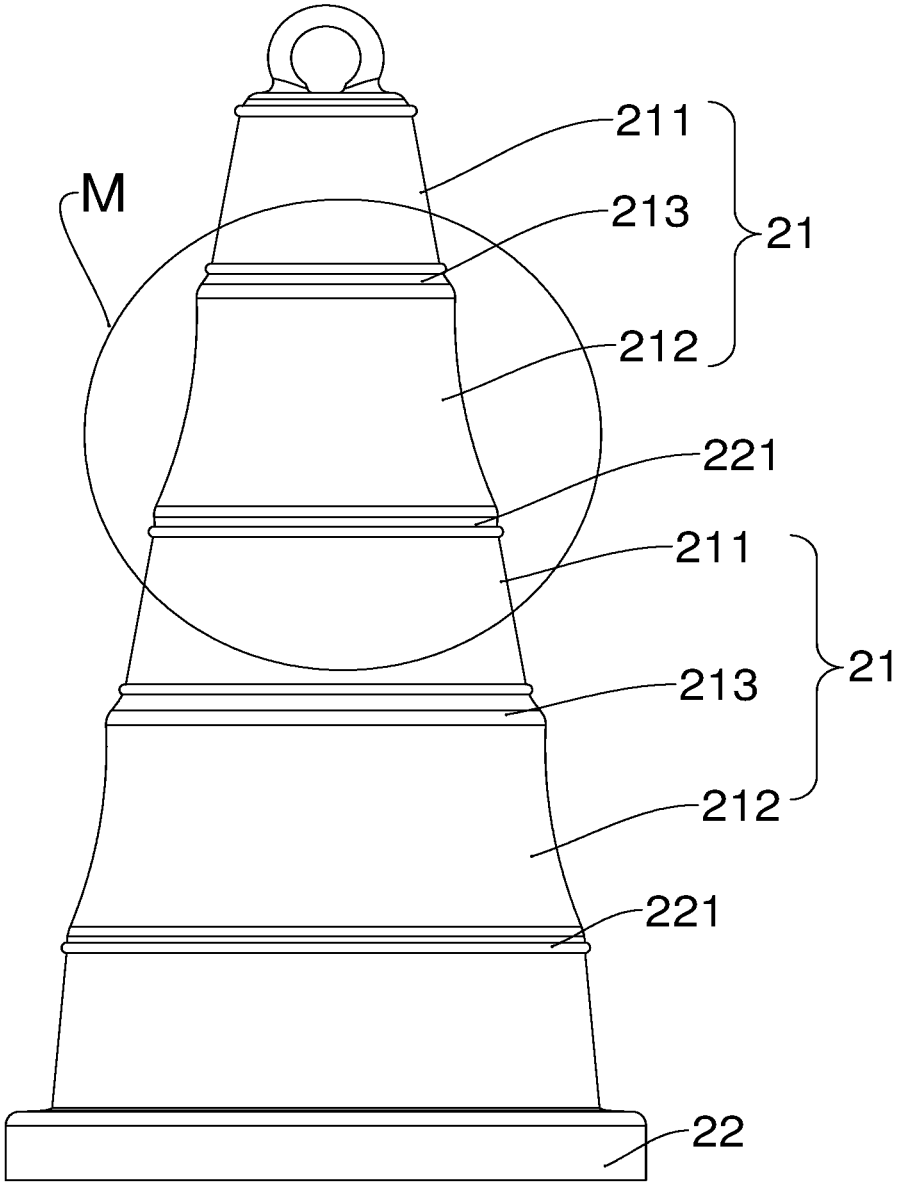
FIG. 4 is a schematic diagram showing a structure of a foldable traffic cone in an expanded state according to Embodiment 2 of the present invention.
Figure 5:
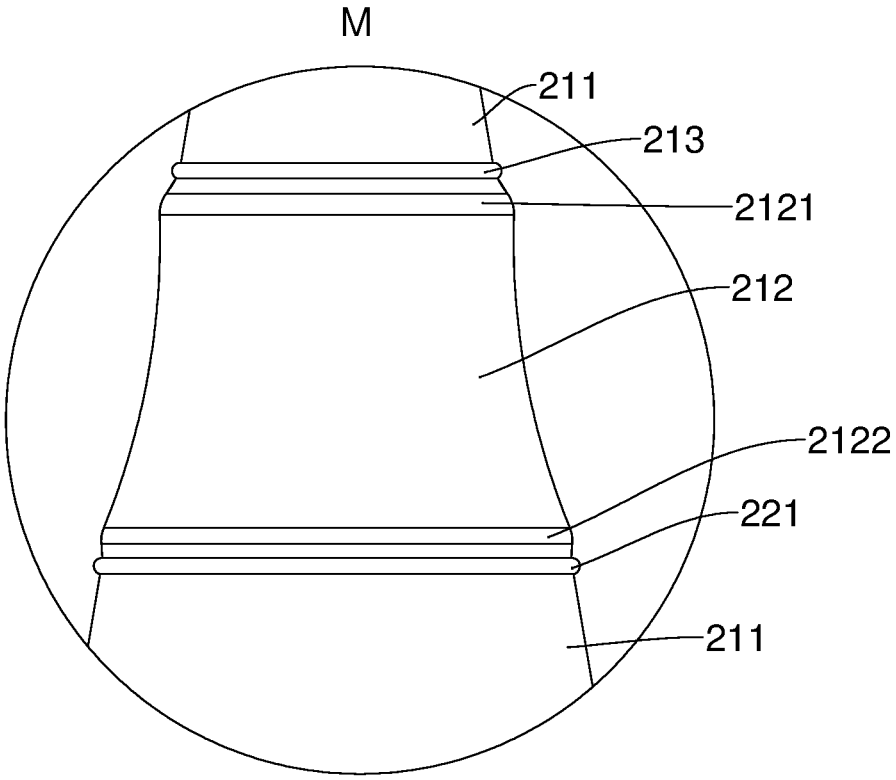
FIG. 5 is a longitudinal section view of FIG. 4.

Embodiment 2: as shown in FIG. 4 and FIG. 5, the embodiment is an improvement of Embodiment 1. The difference lies in that both the first fold 213 and the second fold 221 are annular convex arc-shaped raised edges. The first foldable segment 211 is of a big-end-down frustum shape; the second foldable segment 212 has a side wall being a concave arc-shaped surface and is provided with a convex ring 2121 and a convex ring 2122 respectively at the top and the bottom, and the convex ring 2121 at the top has an outer diameter more than the outer diameter of the bottom of the adjacent first foldable segment 211; and the outer diameter of the convex ring 2122 at the bottom is more than the outer diameter at the top of each of the first fold 213 and the first foldable segment 211.

For one foldable member 21, the upper first foldable segment 211 is to be pressed into the second foldable segment 212 during folding, therefore, the first fold 213 is a convex arc-shaped raised edge, the convex arc-shaped raised edge connected with the first foldable segment 211 has a top face with the diameter smaller than the maximal outer diameter of the convex arc-shaped raised edge, that is, the bottom of the first foldable segment 211 connected with the convex arc-shaped raised edge has the diameter smaller than the outer diameter of the convex arc-shaped raised edge of the first fold 213; and in such a way, the first foldable segment 211 more easily enters the second foldable segment 212 under the guide of the convex arc-shaped raised edge. In addition, the top of the second foldable segment 212 is provided with a convex ring 212, the outer diameter of which is more than both the outer diameter of the bottom of the adjacent first foldable segment 211 and the outer diameter of the first fold 213; in addition, the convex shape of the convex ring 2121 guides the first foldable segment 211 similarly to allow the first foldable segment 211 to enter the second foldable segment 212 conveniently. The convex ring 2122 at the bottom of the first foldable segment 211 is good for the folding of the first foldable segment 211.

Convex rings 2121 and 2122 are disposed at the top and bottom of the second foldable segment 212 to play a supporting role in an expanded state; and the convex ring 2121 and the convex ring 2122 can be reduced in thickness and increased in elasticity to facilitate the folding.

The first foldable segment 211 as described is of a frustum shape with a big end down; and the side wall of the second foldable segment 212 is an inwards arc-shaped arc face. That is, a wall face of the first foldable segment 211 is of a straight tube structure, that is, a longitudinal section is of a linear shape, which is good for keeping the first foldable segment unchanged in shape. A wall face of the second foldable segment 212 is of an arc-shaped structure, that is, a longitudinal section is of an arc-shaped shape, which is good for deformation, folding and compression.

The rest of the structure is the same as that in Embodiment 1, which is not repeated any more for the sake of simplicity.

It can be understood that the embodiments above only state the preferred embodiment of the present invention in specific and detailed description, but cannot be construed as limiting the patent scope of the present invention; it should be noted that those skilled in the art may freely combine the technical features above without departing from the concept of the present invention, and may also make variations and improvements, all of which shall fall within the protection scope of the present invention; therefore, any equivalent alternations and modifications made within the scope of the claims of the present invention shall fall within the scope covered by the claims of the present invention.

What is claimed is:

1. A foldable traffic cone, characterized by comprising:

a base;

a conical or frustum-shaped hollow foldable portion, comprising one or more foldable members and a connecting member connected with the base from top to bottom in sequence, each foldable member comprising a first foldable segment, a first fold and a second foldable segment from top to bottom in sequence, and a second fold being disposed between the second foldable segment at a bottom end of the foldable portion and the connecting member;

a pull ring, which is disposed on the top of the foldable portion, wherein when a plurality of foldable members are present, a second fold is disposed between the second foldable segment of each of the foldable members and the first foldable segment of an adjacent foldable member located therebelow; and at least the foldable portion is an elastically deformable integrated structure molded integrally;

wherein, a thickness of the second fold is more than a thickness of the first fold;

a thickness of the first foldable segment is more than a thickness of the second foldable segment.

2. The foldable traffic cone of claim 1, characterized in that both the first fold and the second fold are annular concave slots.

3. The foldable traffic cone of claim 1, further comprises a support ring clamped into an inner wall of the first foldable segment of each foldable member for supporting the first foldable segment.

4. The foldable traffic cone of claim 1, characterized in that at least two of the pull ring, the foldable portion and the base are of an integrated structure molded from silicone integrally.

5. The foldable traffic cone of claim 1, characterized in that both the first fold and the second fold are annular convex arc-shaped raised edges.

6. The foldable traffic cone of claim 1, characterized in that the first foldable segment or/and the second foldable segment is/are provided with a reflective tape(s) on an outer peripheral wall(s).

7. The foldable traffic cone of claim 1, characterized in that the base is provided with a balancing weight.

8. A foldable traffic cone, comprising:

a base;

a frustum-shaped hollow foldable portion, comprising a plurality of foldable members and a connecting member connected with the base from top to bottom in sequence; wherein, each foldable member comprises:

a first foldable segment;

a second foldable segment comprising a top convex ring disposed at a top of the second foldable segment and a bottom convex ring disposed at a bottom of the second foldable segment;

a first fold connected between the first foldable segment and the top convex ring of the second foldable segment;

a second fold connected the bottom convex ring of the second foldable segment to the next foldable member adjacent to such second foldable segment or to the connecting member;

a pull ring, which is disposed on a top of the foldable portion;

at least the foldable portion is an elastically deformable integrated structure molded integrally; wherein, an outer diameter of the top convex ring is more than that of the first foldable segment that is adjacent to the top convex ring; and the outer diameter of the top convex ring is more than that of the first fold that is adjacent to the top convex ring.

9. The foldable traffic cone of claim 8, wherein, the first fold and second fold are annular convex arc-shaped raised edges.

10. The foldable traffic cone of claim 8, wherein, a thickness of the first fold is more than that of the second fold.

11. The foldable traffic cone of claim 8, wherein, a thickness of the first foldable segment is more than that of the second foldable segment.

12. The foldable traffic cone of claim 8, wherein, the second foldable segment has a side wall being a concave arc-shaped surface.

13. The foldable traffic cone of claim 8 further comprises a support ring clamped into an inner wall of the first foldable segment of each foldable member for supporting the first foldable segment.

* * * * *